US006095258A

United States Patent [19]

Reese et al.

[11] Patent Number: 6,095,258

[45] Date of Patent: Aug. 1, 2000

[54] PRESSURE ACTUATED SAFETY SWITCH FOR OIL WELL PERFORATING

[75] Inventors: James W. Reese; Craig A. Beveridge, both of Spring, Tex.

[73] Assignee: Western Atlas International, Inc., Houston, Tex.

[21] Appl. No.: 09/141,792

[22] Filed: Aug. 28, 1998

[51] Int. Cl.[7] ..... E21B 43/116; E21B 29/02; F23Q 7/02; F42B 1/00

[52] U.S. Cl. ..... 175/4.54; 175/4.56; 166/65.1; 166/55.1; 102/206; 102/306

[58] Field of Search ..... 102/312, 313, 102/301, 206, 251, 306; 89/1.15; 175/4.51, 4.55, 4.56, 4.54, 4.52, 4.53, 4.5, 4.6; 166/385, 55.1, 53, 55, 65.1, 297, 298

[56] References Cited

U.S. PATENT DOCUMENTS

| | | | |
|---|---|---|---|
| 3,282,213 | 11/1966 | Bell et al. | 166/55 |
| 3,465,836 | 9/1969 | Fields | 175/4.51 |
| 3,601,196 | 8/1971 | Childers et al. | 166/297 |
| 3,612,189 | 10/1971 | Brooks et al. | 175/4.54 |
| 3,648,785 | 3/1972 | Walker | 175/4.54 |
| 3,709,239 | 1/1973 | Morck, Jr. | 137/68 |
| 3,865,199 | 2/1975 | Dermott | 175/4.51 |
| 3,923,099 | 12/1975 | Brandon | 166/249 |
| 3,994,338 | 11/1976 | Hix | 166/105 |
| 4,046,156 | 9/1977 | Cook | 137/68 A |
| 4,179,991 | 12/1979 | Echols et al. | 175/4.6 |
| 4,193,460 | 3/1980 | Gilbert | 175/4.6 |
| 4,428,440 | 1/1984 | McPhee | 102/310 |
| 4,458,516 | 7/1984 | Naumann | 72/57 |
| 4,492,103 | 1/1985 | Naumann | 72/55 |
| 4,589,484 | 5/1986 | Doherty et al. | 166/179 |
| 4,605,074 | 8/1986 | Barfield | 175/4.52 |
| 4,778,009 | 10/1988 | Sumner et al. | 166/55.1 |
| 4,830,120 | 5/1989 | Stout | 175/4.51 |
| 4,886,126 | 12/1989 | Yates, Jr. | 175/4.54 |
| 5,203,414 | 4/1993 | Hromas et al. | 166/382 |
| 5,341,883 | 8/1994 | Ringgenberg | 166/324 |
| 5,483,895 | 1/1996 | Tomek et al. | 102/312 |
| 5,533,454 | 7/1996 | Ellis et al. | 102/202.7 |
| 5,756,926 | 5/1998 | Bonbrake et al. | 102/215 |

FOREIGN PATENT DOCUMENTS

| | | | |
|---|---|---|---|
| 648162 | 9/1962 | Canada | 166/55 |
| 396465 | 11/1990 | European Pat. Off. | 175/4.55 |
| 601880 | 6/1994 | European Pat. Off. | 166/55 |
| 1157208 | 5/1985 | U.S.S.R. | 166/55 |
| 1204704 | 1/1986 | U.S.S.R. | 166/55 |
| 1221327 | 3/1986 | U.S.S.R. | 166/55 |
| 1232781 | 5/1986 | U.S.S.R. | 166/55 |
| WO 94/21882 | 9/1994 | WIPO | 175/4.54 |

OTHER PUBLICATIONS

Sales Brochure (Data Sheet 8051), "A8051–X Pressure Actuation Device," Fike Corporation, 704 S. 10th St., Blue Springs, MO 64105 Nov. 1997.

*Primary Examiner*—Michael J. Carone
*Assistant Examiner*—Fredrick T. French, III
*Attorney, Agent, or Firm*—Darryl M. Springs; Madan, Mossman & Sriram

[57] ABSTRACT

A perforating gun assembly for perforating wellbores, comprising a shaped charge carrier assembly, a detonating cord for initiation OF shaped charges in the carrier assembly, an initiator attached to the detonating cord for initiating the cord on application of an electrical control signal to the detonator, and a pressure safety switch connected to the initiator. The pressure safety switch electrically connects the initiator to an electrical cable for carrying the control signal, when a preselected pressure is applied to the pressure safety switch.

8 Claims, 3 Drawing Sheets

1
34
30
12
14
18
16
25
24
10
22
20
13
20

PRESSURE ACTUATED SAFETY SWITCH FOR OIL WELL PERFORATING

BACKGROUND OF THE INVENTION

1. Field of the Invention

The invention is related to the field of petroleum wellbore perforating using high explosive shaped charges. More specifically, the invention is related to safety devices to prevent unintended detonation of an explosive oil well perforating gun at any place other than the selected depth in the wellbore.

2. Description of the Related Art

Petroleum wellbore perforating uses high explosive shaped charges to create "perforations" in steel casing included in completed wellbores. The shaped charges are detonated by a signal from a detonating cord attached to or in close proximity to the shaped charges. The detonating cord is itself initiated by a blasting cap, exploding bridgewire or similar initiator. See for example, U.S. Pat. No. 5,533,454 issued to Ellis et al for a description of an exploding bridgewire firing circuit, and U.S. Pat. No. 4,428,440 issued to McPhee for a description of a perforating gun assembly including shaped charges, charge carrier, detonating cord and initiator.

Various safety systems have been developed to reduce the chance of unintended detonation of the shaped charges by accidental firing of the initiator. For example, the exploding bridgewire firing system described in the Ellis et al '454 patent is intended to reduce the possibility of unintended detonation of the shaped charges as a result of stray radio frequency energy firing a blasting cap initiator. Other systems for preventing unintended detonation include key-locking switches which shunt the electrical cable connected to the perforating "gun" assembly (as described for example in the Ellis et al '454 patent) through resistors to prevent electric charge build up on the cable from accidentally initiating the blasting cap or exploding bridgewire circuit.

More recently, users of oil well perforating equipment have developed a technique known as "electric before ballistic arming" to reduce the consequences of unintended initiation of the blasting cap or exploding bridgewire ("initiator"). Generally speaking, in this technique all electrical connections between the initiator and the electrical cable (used to lower the gun into the wellbore) are made prior to attaching the initiator to the detonating cord. This procedure is based on the probability that any accidental firing of the initiator will take place immediately or shortly after the electrical connections are made. If the initiator is not yet attached to the detonating cord at the time of accidental firing, the consequences of the unintended firing will be limited to the damage caused solely by the initiator's release of energy, which is relatively small. Otherwise, the full energy of the exploding shaped charges would be accidentally released at the earth's surface, with a high probability of loss of life and severe damage to property.

The "electric before ballistic arming" safety technique is impracticable to use on perforating gun assemblies which exceed the lifting height of equipment located at the well site, however. This equipment includes drilling rigs or completion/workover rigs as is known in the art. These types of rigs typically have a maximum lifting height of about 90 feet. It has become quite common to perforate wellbores using a single perforating gun assembly having much more widely spaced apart perforation intervals, and consequently much greater overall gun length, than the 90 foot lifting height of the typical drilling or workover rig. See for example U.S. Pat. No. 5,533,454 issued to Ellis et al for a description of a perforating gun assembly having multiple perforation intervals.

SUMMARY OF THE INVENTION

The invention is a shaped charge gun assembly for perforating wellbores, comprising a shaped charge carrier assembly holding shaped charges in it, a detonating cord for initiation of detonation of the shaped charges, an initiator attached to the detonating cord for initiating detonation of the cord on application of an electrical control signal to the initiator, and a pressure safety switch connected between the initiator and an electrical cable which carries the control signal from the earth's surface to the gun assembly. The pressure safety switch completes the circuit from the surface to the gun assembly when a preselected pressure is applied to the pressure safety switch. The pressure safety switch comprises a rupture disc exposed to pressure in the wellbore on one side, a sealed chamber in hydraulic communication with the other side of the rupture disc and a pressure actuated switch, whereby rupture of the disc by pressure in the wellbore exposes the fluid pressure in the wellbore to the pressure actuated switch, to close the pressure actuated switch and electrically connect the initiator to the cable.

DESCRIPTION OF THE PREFERRED EMBODIMENT

Figure 1:
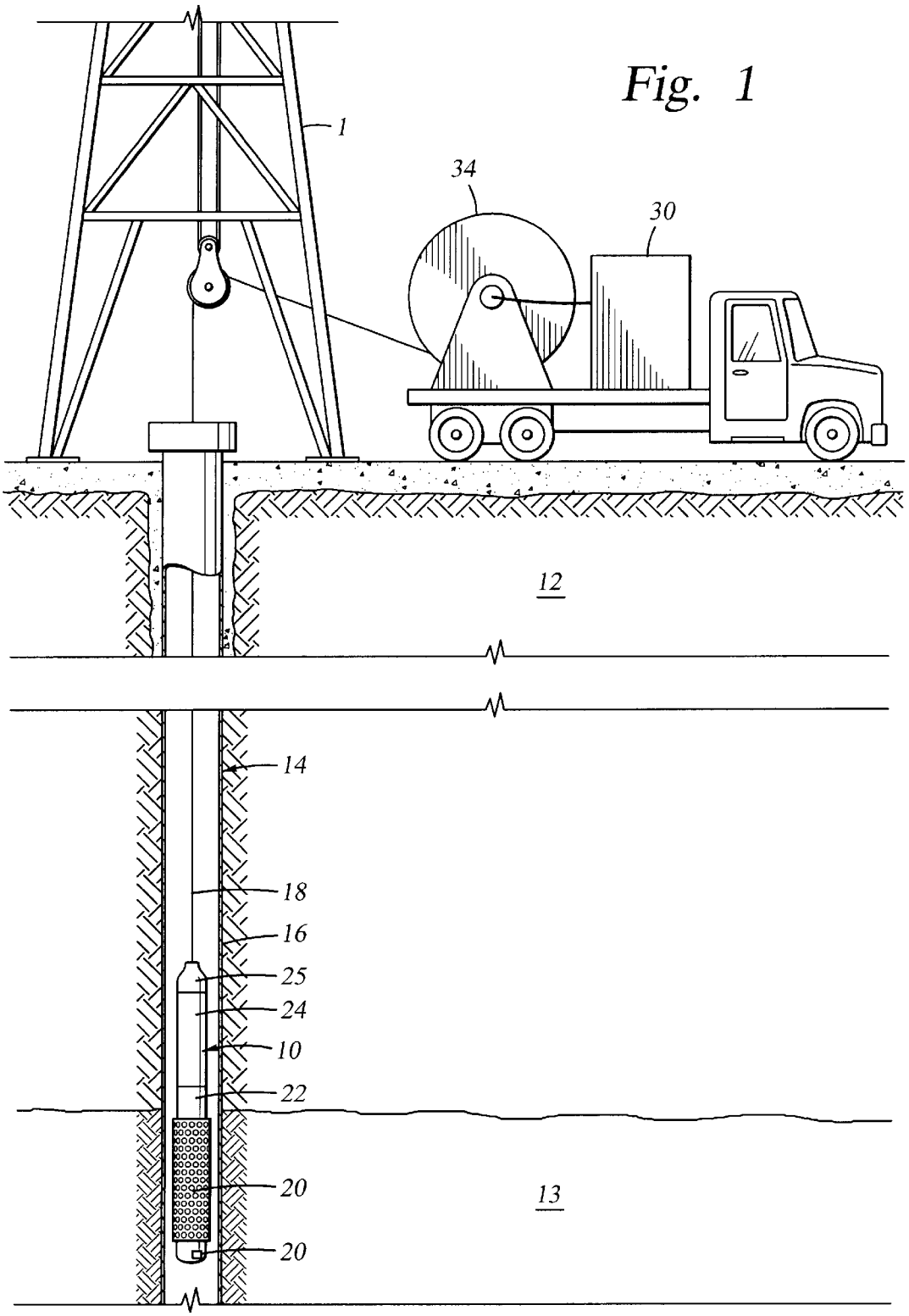
FIG. 1 shows an oil well perforating gun assembly including a safety switch according to the invention.

FIG. 1 shows the invention as it is typically used in combination with an oil well perforating gun assembly. The oil well 14 is drilled through earth formations 12 until a selected formation 13 is reached. The well 14 is completed with a steel casing 16 cemented in place to hydraulically isolate the selected formation 13 from the other earth formations 12.

A perforating gun assembly 10 is lowered into the well 14 by means of an electrical cable 18 comprising at least one insulated electrical conductor (not shown). The cable 18 is lowered into the well 14 by means of a winch 34 or similar device known in the art until the gun assembly 10 is located at the depth of the selected formation 13.

The gun assembly 10 typically includes a firing circuit 24, an exploding bridgewire ("EBW") initiator and booster 22, and explosive shaped charges (not shown separately) positioned in a charge carrier assembly 20. The gun assembly 10 is attached to the cable 18 by a cable head 25, which makes both electrical and mechanical connections from the assembly 10 to the cable 18. The firing circuit 24 for the EBW initiator and booster 22 can be one such as described in U.S. Pat. No. 5,533,454 issued to Ellis et al, for example. The invention can also be used with blasting cap type initiators, which do not require the special firing circuit associated with EBW detonators. It should be understood that the invention can be used with any type of electrically activated initiator and is therefore not limited to EBW initiators.

The gun assembly 10 includes a pressure actuated safety switch 21, generally located at the bottom of the gun assembly 10. The safety switch 21 interrupts electrical connection between the cable 18 and the firing circuit 24 until a preselected pressure is applied to the safety switch 21, as will be further explained.

Figure 2:
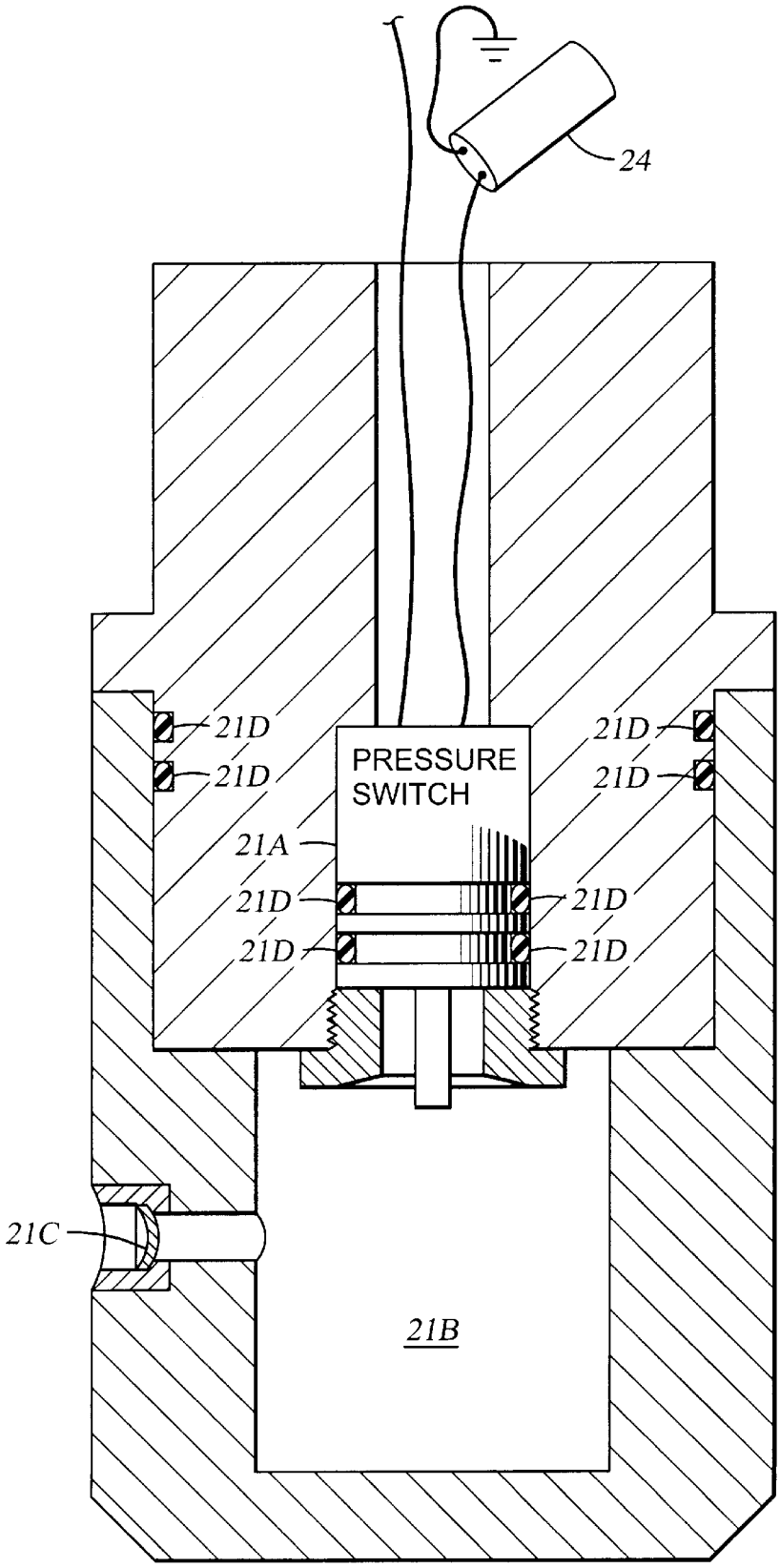
FIG. 2 shows the safety switch of the invention in more detail.

The pressure actuated safety switch 21 is shown in more detail in FIG. 2. The safety switch 21 includes a pressure activated switch 21A, which is normally exposed to a pressure sealed chamber 21B. The switch 21A is normally open until the selected pressure is applied to it, and is electrically connected between the cable 18 and the initiator 24. The chamber 21B can be hydraulically separated from the exterior of the gun assembly (10 in FIG. 1), and therefore the pressure in the well (14 in FIG. 1) by o-ring seals 21D and a rupture disc 21C. Normally, the chamber 21B will be at atmospheric pressure until the disc 21C is ruptured.

The rupture disc 21C can be selected by the system operator to burst at any preselected pressure. Suitable rupture discs are described, for example, in a sales brochure published by Fike Corporation, 704 S. 10th St., Blue Springs, Mo. 64105, which shows their model number A8051-X "pressure actuation device".

Typically the selected burst pressure for the rupture disc 21C is related to the expected hydrostatic fluid pressure in the well (14 in FIG. 1) at the depth of the selected formation (13 in FIG. 1). The selected burst pressure may be slightly below the expected hydrostatic pressure in the wellbore at the depth of the selected formation (13 in FIG. 1) so that the gun assembly (10 in FIG. 1) becomes "armed" by closing the switch 21A when the gun assembly 10 nears the selected depth in the well 14. Another appropriate value for the burst pressure of the rupture disc 21C would be a pressure which is several hundred PSI (approximately) above the expected hydrostatic pressure at the selected depth in the well 14. The wellbore operator can then apply fluid or gas pressure to the well 14 at the earth's surface to cause the total pressure (surface pressure plus hydrostatic pressure) at the outside of the rupture disc 21C to exceed the burst pressure of the rupture disc 21C when the gun assembly 10 is positioned at the selected depth. Then the surface pressure can be released before detonating the perforating gun assembly 10. This method can prevent accidental rupturing of the disc by compression of fluids in the well 14 at a shallower depth than selected as the gun assembly 10 is lowered into the well 14.

When the rupture disc 21C is broken by the total external pressure, exceeding the burst pressure, the fluid pressure in the well 14 is then communicated to the chamber 21B and thereby to the pressure switch 21A. The pressure switch 21A can be selected to have an actuation pressure substantially less than the expected hydrostatic pressure to ensure its closing when the external pressure is communicated to the chamber 21B and switch 21A through the ruptured disc 21C. When the pressure is communicated to the switch 21A, it closes electrically, completing a circuit from the cable (18 in FIG. 1) to the EBW firing circuit (24 in FIG. 1), blasting cap or the like, as previously explained. This, in turn, detonates the detonating cord 27.

Then under the control of the system operator, a surface control unit 30 is operated to apply an electrical voltage to the cable 18 to detonate the gun assembly 10 when desired.

Figure 3:
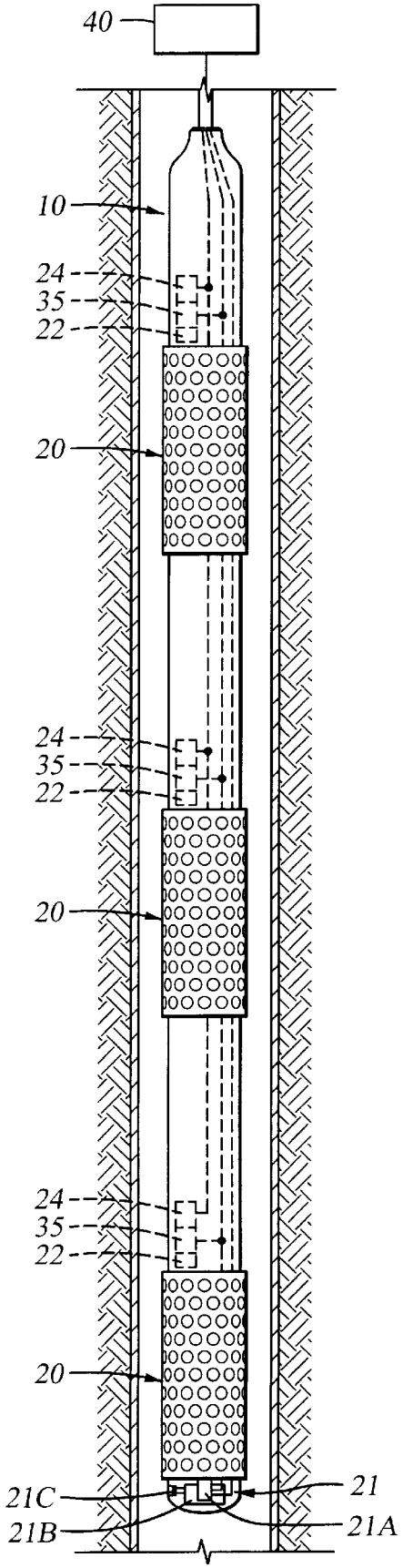
FIG. 3 shows a perforating gun assembly including multiple shaped charge carriers for perforating a plurality of different formations using one gun assembly.

The invention is suitable for use in extended length gun assemblies which are used to perforate a plurality of different formations separated by a depth which makes the entire gun assembly longer than the lifting height of the lifting equipment at the wellbore, such as a completion rig derrick (shown at 1 in FIG. 1). FIG. 3 shows a plurality of gun carriers 20 and a plurality of EBW firing circuits 24, such as shown in the Ellis et al '454 patent, each with a different frequency bandpass filter 35, in the same gun assembly 10 for perforating a plurality of different formations (such as shown at 13 in FIG. 1). Detonation of a selected gun carrier 20 can be accomplished by charging the cable 18 with AC of a frequency which matches the frequency of the bandpass filter 35 of the selected gun carrier 22. The AC can be generated by a selectable frequency source 40 connected to the cable 18. As previously explained, the entire gun assembly 10 can be electrically connected to the cable 18 by applying pressure to the safety switch 21 which exceeds the burst pressure of the rupture disc 21C, which causes the pressure to be communicated to the pressure switch 21A through the chamber 21B.

It is to be clearly understood that the gun assembly 10 shown in FIG. 3 is not limited to using selective frequency AC firing circuits as shown in the Ellis et al '454 patent. Selective polarity DC firing circuits for EBW detonators, as well known in the art, may also be used.

Those skilled in the art will devise other embodiments of the invention which do not depart from the spirit of the invention as disclosed herein. Accordingly, the scope of the invention should be limited only by the attached claims.

What is claimed is:

1. A gun assembly for perforating wellbores, comprising:

(a) a shaped charge carrier assembly;

(b) a detonating cord for initiation of detonation of shaped charges in said carrier assembly;

(c) an initiator attached to said detonating cord for initiating detonation of said cord on application of an electrical control signal to said initiator; and (d) a pressure safety switch connected through an electrical cable to a surface control unit, the pressure safety switch comprising:

(i) a rupture disc exposed to pressure in said wellbore on one side of said disc and having a sealed chamber in hydraulic communication with a second side of said disc, and (ii) a pressure actuated switch in hydraulic communication with said chamber, said pressure actuated switch closing upon exposure to said wellbore pressure upon rupture of said rupture disc;

wherein closing of said pressure actuated switch completes an electrical circuit between said initiator and the surface control unit, thereby enabling initiation of said detonation by an application of an electrical voltage by the surface control unit to said cable.

2. The perforating gun assembly as defined in claim 1 wherein said rupture disc has a selected burst pressure higher than an expected hydrostatic pressure in said wellbore, so that fluid pressure applied to said wellbore at the earth's surface combined with hydrostatic pressure in said wellbore causes rupture of said disc.

3. The perforating gun assembly as defined in claim 1 wherein said rupture disk has a selected burst pressure approximately equal to an expected hydrostatic pressure in said wellbore, so that fluid pressure in said wellbore at a selected perforating depth ruptures said disk and closes said pressure actuated switch.

4. An electrically safe initiator for an explosive gun assembly for perforating a wellbore, comprising:

(a) an electrically actuated initiator;

(b) a pressure actuated switch on a pressure safety switch assembly interconnected between said electrically actuated initiator and a source of an electrical control signal at the surface of the earth for actuating said electrically actuated initiator, said pressure actuated switch in pressure communication with a chamber on the pressure safety switch assembly, said chamber hydraulically sealed to exclude pressure from said wellbore, an opening of said chamber to said wellbore sealed by a rupture disk having a preselected burst pressure, whereby application of pressure exceeding said preselected pressure causes rupture of said disc, and closure of said pressure actuated switch thereby completing an electrical circuit between the electrically actuated initiator and the source of said electrical signal.

5. The electrically safe initiator as defined in claim 4 wherein said rupture disc has a selected burst pressure higher than an expected hydrostatic pressure in said wellbore, so that fluid pressure applied to said wellbore at the earth's surface combined with hydrostatic pressure in said wellbore causes rupture of said disc.

6. The electrically safe initiator as defined in claim 4 wherein said rupture disc has a selected burst pressure approximately equal to an expected hydrostatic pressure in said wellbore, so that fluid pressure in said wellbore at a selected perforating depth ruptures said disc and closes said pressure switch.

7. The electrically safe initiator as defined in claim 4 wherein said electrically actuated initiator comprises a blasting cap.

8. The electrically safe initiator as defined in claim 4 wherein said electrically actuated initiator comprises an exploding bridgewire and a firing circuit therefor.

* * * * *